United States Patent [19]

Fisher et al.

[11] 4,291,753

[45] Sep. 29, 1981

[54] SCRAPER ASSEMBLY FOR USE WITH A FLUIDIZED BED CONDENSER

[75] Inventors: Richard L. Fisher; David J. Wright; Randall Scheel, all of Albany, Oreg.

[73] Assignee: Teledyne Industries, Inc., Los Angeles, Calif.

[21] Appl. No.: 9,940

[22] Filed: Feb. 7, 1979

[51] Int. Cl.[3] ..... F28G 3/10

[52] U.S. Cl. ..... 165/94; 422/145; 55/295; 241/283; 366/194

[58] Field of Search ..... 165/94, 95; 366/194, 366/279, 309, 312; 241/277, 283; 55/71, 295, 6, 474, 71; 422/145, 139; 126/173

[56] References Cited

U.S. PATENT DOCUMENTS

| | | | |
|---|---|---|---|
| 1,860,442 | 5/1932 | Wares | 126/173 |
| 2,110,804 | 3/1938 | Ludi et al. | 126/173 |
| 2,159,463 | 5/1939 | Voorheis | 165/94 |
| 2,941,862 | 6/1960 | Cyr et al. | 422/139 |
| 2,943,704 | 7/1960 | Coates et al. | 55/71 |
| 2,993,681 | 7/1961 | McCall | 165/95 |
| 3,079,993 | 3/1963 | Sweet | 55/296 |
| 3,495,383 | 2/1970 | Nelson | 366/312 |

FOREIGN PATENT DOCUMENTS

| | | | |
|---|---|---|---|
| 994993 | 6/1965 | United Kingdom | 366/157 |

*Primary Examiner*—Samuel Scott
*Assistant Examiner*—Theophil W. Streule, Jr.
*Attorney, Agent, or Firm*—Shoemaker and Mattare, Ltd.

[57] ABSTRACT

A fluidized bed condenser for use in condensing zirconium tetrachloride or hafnium tetrachloride vapor into solid zirconium tetrachloride or hafnium tetrachloride includes a scraper assembly. The scraper assembly includes at least one scraper arm located adjacent an inlet through which fluid zirconium tetrachloride or hafnium tetrachloride enters the condenser vessel. A cleanout rod is also mounted on the vessel to clean out the inlet, and the scraper includes a cleanout assembly for preventing build up of solid material in a solid outlet area defined in the vessel.

12 Claims, 2 Drawing Figures

SCRAPER ASSEMBLY FOR USE WITH A FLUIDIZED BED CONDENSER

BACKGROUND OF THE INVENTION

The present invention relates in general to condensation, and, more particularly, to condensation of zirconium tetrachloride and/or hafnium tetrachloride to a free-flowing solid.

In the production of zirconium, zirconium is recovered as a co-product from zirconium sand. Broadly, the recovery process includes the steps of separating rutile and ilmenite and zirconium in an ore dressing step from zirconium sand. The process also includes: ball milling; sand chlorination, feed makeup; separation; precipitation; calcination; pure chlorination; reduction; distillation; a breakup process; crushing; blending; pressing; beam welding; melting into ingots; machining; and fabricating a wrought product from the final machine ingots. The production of hafnium is similar to the steps above and variations thereof required for the production of hafnium are known to those skilled in the art.

Fluid bed condensers are often used in at least one step of the just-described production process. In at least one of these condensers, zirconium tetrachloride and hafnium tetrachloride is condensed to free-flowing solids. The condenser used often includes a water cooled jacket. It has been found that solid material builds up in and adjacent the inlet used to conduct vapor into the vessel. The build up of solid in and at the inlet presents problems. The influx is reduced, and, if the outlet is not cleared, eventually influx is stopped.

For example, in the production if zirconium tetrachloride, zirconium tetrachloride vapor enters a condenser via an intake pipe, and is kept in a vapor state until it enters the fluidized bed condenser by heaters surrounding the intake pipe. Caking of zirconium tetrachloride around the entrance of the intake pipe to the condenser is a phenomena caused because heat applied to the vapor by a heater used on the intake pipe nullifies the cooling effect of a cooling jacket surrounding the condenser. The heater causes a local overheating of the cooling fluid, which surrounds the condenser at the entrance opening. As a result of this localized overheating, the zirconium tetrachloride cakes around the intake pipe opening. This caking continually builds as new zirconium tetrachloride vapor condenses on the zirconium tetrachloride particles already attached to the side of the condenser adjacent the intake pipe opening into the condenser. Large particles result, of the nature of sintered products at the opening, thus blocking the inflow of zirconium tetrachloride vapor. This phenomena does not occur in other parts of the condenser as the water cooling in parts of the condenser remote from the aforementioned heaters are effective to prevent attachment of zirconium tetrachloride to the surface of the condenser.

SUMMARY OF THE INVENTION

The device embodying the teachings of the present invention permits condensation of zirconium tetrachloride or hafnium tetrachloride in a fluidized bed condenser in a manner which prevents build up of solid material in or at an inlet of zirconium tetrachloride or hafnium tetrachloride gas.

The device includes a scraper mounted in a condensing vessel adjacent the gas inlet. The scraper is rotated or otherwise moved and dislodges solid particles from in and around the inlet. The device also includes a cleanout rod movably positioned to be inserted into the inlet to further clean out that inlet. A further cleanout device is affixed to the scraper to be extendable into the solid outlet line. This further cleanout assembly can be used to clear the solid outlet line periodically or continuously as suitable. The scraper is used in a fluidized bed condenser in either a process involving zirconium tetrachloride or in a process involving hafnium tetrachloride.

OBJECTS OF THE INVENTION

It is, therefore, a main object of the present invention to prevent or inhibit build up of solid material in and at a gas inlet into a zirconium tetrachloride or hafnium tetrachloride fluidized bed condenser.

It is another object of the present invention to prevent or inhibit build up of solid material in or at a solid outlet from a zirconium tetrachloride or hafnium tetrachloride fluidized bed condenser.

It is yet another object of the present invention to provide cleanout means for cleaning out solid material built up in a gas inlet into a zirconium tetrachloride or hafnium tetrachloride fluidized bed condenser.

These together with other objects and advantages which will become subsequently apparent reside in the details of construction and operation as more fully hereinafter described and claimed, reference being had to the accompanying drawings forming part thereof, wherein like reference numerals refer to like parts throughout.

DETAILED DESCRIPTION OF THE INVENTION

Figure 1:
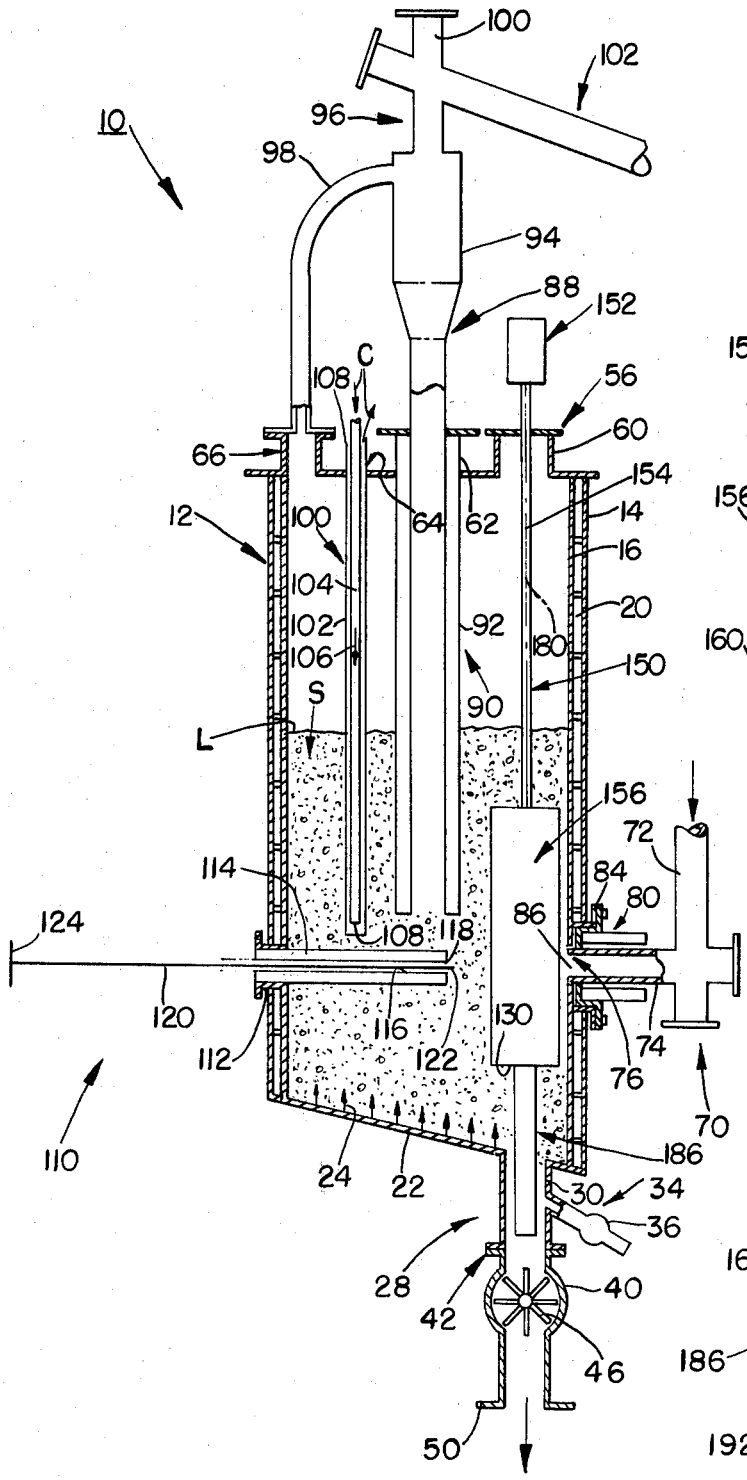
FIG. 1 is an elevation view of a fluidized bed condenser using a scraper embodying the teachings of the present invention.

Shown in FIG. 1 is a fluidized bed condenser assembly 10 for forming a solid S and which includes a vessel having an outer wall 14 and an inner wall 16 between which are sandwiched a plurality of cooling channels 20 through which cooling fluid is circulated to cool the vessel. The vessel 12 includes a sloping bottom 22 from which fluidized gas 24, such as nitrogen, or the like, is injected. An outlet 28 is defined in the vessel bottom and includes a branched outlet line 30 having a sample line 34 branched therefrom. A sample valve 36 is located in the line 34. A valve unit 40 is attached to a main branch of the outlet line 30 via flanges 42, or the like, and includes a valve 46, such as a rotary valve, or the like, located downstream of the vessel 12. The valve unit can be connected via flanges 50 to any suitable line for moving solid to a storage means. As is also shown in FIG. 1, the vessel 12 has a top section 56 which includes a plurality of access ports 60, 62, 64 and 66 defined therein.

It is noted that the assembly shown in FIG. 1 is most suitable for use with zirconium tetrachloride. However, an assembly useful with hafnium tetrachloride will be quite similar, and differ from the embodiment shown in FIG. 1 in ways clearly evident to those skilled in the art. Therefore, for the sake of convenience, this description will be directed to zirconium tetrachloride, but it is understood that the scraper concept, elements, operations, and functions, as well as the cleanout rod and cleanout element concepts, elements, operations and functions are equally applicable to use with hafnium tetrachloride. These elements need not be described twice, and thus, the single description for zirconium tetrachloride is presented only for the sake of convenience, and is not intended to be limiting. Accordingly, the following disclosure will be directed to zirconium tetrachloride with the thought in mind that it is equally applicable to hafnium tetrachloride with only those modifications evident to those skilled in the art.

As shown in FIG. 1, the solid S will be zirconium tetrachloride and has a level indicated by the reference indicator L. This material is formed within the vessel 12 by methods known to those skilled in the art. Zirconium tetrachloride gas flows into a transfer unit 70 via a transfer unit inlet line 72. The gas is conducted into a vessel inlet line 74 which is connected to an inlet port 76 defined in the shell wall of the vessel. A heating unit 80, such as radiant high temperature electric heating elements, surrounds inlet line 74. The inlet 74 is mounted on the vessel by flanges 84, or the like. The inlet port 76 has an entrance area 86 through which material moves into the interior of the vessel. The vessel includes the usual equipment, such as a cyclone assembly 88 having a dip leg 90 extending into the vessel via port 62 and includes an outer tube 92. An outlet cyclone mechanism 94 is located adjacent the vessel top and a branched connection 96 is connected to the cyclone 94 as is inlet line 98 which connects the cyclone with port 66. The branched connection 96 includes a cyclone transfer pipe 100 and an off-gas line 102. The off-gas line is connected to a standard water jacketed space condenser. It is noted that the just-described equipment, such as the cyclone assembly, will be slightly modified in a process involving hafnium tetrachloride. However, those skilled in the art will understand the modifications required, and thus, such modifications will not be herein described.

A number of cooling units, typified by 100, has cooled water flowing therethrough and extends longitudinally downward into the vessel via port 64. The cooling unit 100 includes an open ended downcomer pipe 102 positioned within a closed ended riser pipe 104. Coolant 106 flows out of open end 108 of the downcomer and upwardly in the riser as indicated by the arrows C in FIG. 1.

A cleanout assembly 110 is associated with the vessel and includes a port 112 defined in one wall of the vessel. The cleanout assembly further includes a sheath 114 extending radially inward of the vessel and which is in axial alignment with inlet line 74. The sheath has an axial bore 116 defined therein to be axially aligned with the inlet line 74 and an open end 118 of the sheath is located within the vessel to be essentially in spaced parallelism with entrance area 86. A cleanout rod 120 is slidingly received within bore 118 of the sheath and includes a piercing point 122 on one end and a ram 124 on the other end. The ram is associated with equipment (not shown) for moving the rod axially within the sheath 114. As is evident from FIG. 1, appropriate movement of the cleanout rod forces that rod into and through the entrance area 86 and into the inlet line 74 to cleanout any solid material tending to build up in that inlet line.

Figure 2:
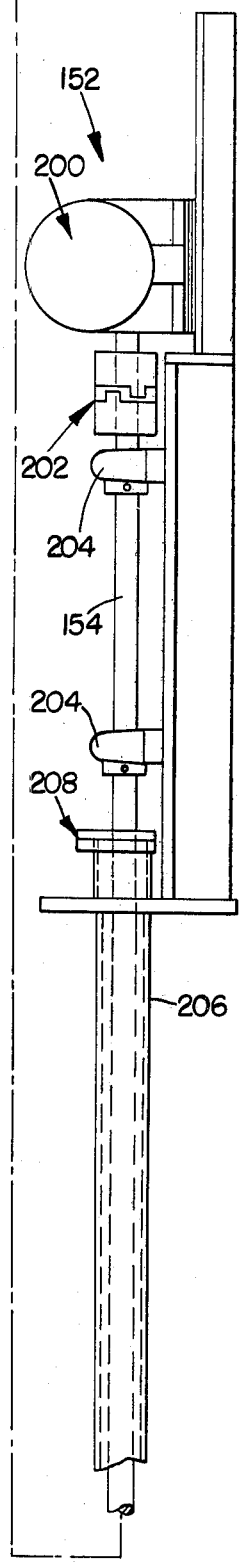
FIG. 2 is an elevation view of a scraper assembly embodying the teachings of the present invention.

As above-discussed, during operation of the assembly 10, solid material tends to build up at and adjacent the entrance area 86 tending to clog or close that area. To prevent such build up, a scraper mechanism 150 is associated with and mounted on the vessel 12. The scraper mechanism includes a drive unit 152 mounted on top of the vessel and a drive shaft 154 is connected at a top end thereof to the drive unit 152 and extending downwardly into the vessel via port 60. A scraper 156 is connected to a distal, or bottom end of the drive shaft 154, and is located adjacent entrance area 86. The scraper is best shown in FIG. 2 to include a frame 160 having scraping arms 162 which are oriented to extend longitudinally of the vessel. The arms are each connected to top and bottom cross members 166 and 168, respectively. Support struts 170 and 172 extend at an angle across the frame 160. Support arms 176 connect the drive shaft 154 to the frame 160, and the lowermost end 178 of the drive shaft 154 can also be affixed to the top of the frame.

An alternative embodiment of the scraper can include a scraper having a circular shape and plan cross-section with a plurality of arms thereon. The alternative form of the scraper would thus include more arms than those shown in FIG. 2 with the arms being radiating outwardly from a central access which is aligned with longitudinal access 180 of the drive shaft. Other scraper configurations can also be used if desired.

A cleanout assembly 186 is affixed to the scraper at the lower, distal end 190 thereof. The cleanout assembly includes a plurality of downwardly extending arms 188 affixed at the top ends thereof to lower cross member 168 of the frame 160 and has a bottom cross member 191 connecting the lower ends of the arms together. A cross brace 192 adds further support to the arms 188 and is connected thereto to be at an angle with respect to the longitudinal centerline of the scraper.

As best shown in FIG. 1, the cleanout assembly extends into the outlet 28, and upon movement of the scraper assembly, either rotational or translational, will tend to free any bound material in that outlet. The scraper assembly can be mounted to be movable along the longitudinal centerline 180 of the drive shaft to move the cleanout assembly into and out of the outlet 28 as suitable. Furthermore, the cleanout assembly 186 itself can be telescopingly mounted on the scraper to accomplish this function.

As best shown in FIG. 2, the drive assembly 152 includes a motor 200, such as a right angle gear motor, or the like, a coupling 202 connecting the motor to the top, proximal, end of the drive shaft and a pair of pillow block bearings 204. A tube 206 extends through port 60 and includes a packing gland seal 208 on the top thereof. The drive shaft extends through the tube 206 and out an open end thereof. Appropriate gear reducers, governors, and the like, can also be used within the drive unit. Appropriate power sources (not shown) and control systems (not shown) can also be associated with the drive unit. The control systems can include programs to automatically operate the scraper at suitable times while leaving that assembly stationary at other times if so desired. Types and variations in control and operations of the scraper assembly will occur to those skilled in the art based on the just-presented disclosure. Further rotational and translational movement and speeds for the scraper unit also occur to those skilled in the art as a result of this disclosure.

As can be seen from the foregoing description, operation of the scraper assembly will prevent build-up of solid material in and around the entrance area 86, and also in and around the outlet 28 if the cleanout assembly 186 is used. The scraper arms 162 moves solid material away from the entrance area and will scrape such material off the inside of the vessel 12 if that material has built up during a period of scraper inaction. The cleanout rod 120 can be operated to extend through open areas in the frame 160, or the scraper can be moved upwards in the vessel to permit operation of the cleanout rod, if suitable. It is also noted that operation of the scraper assembly will stir up the solid material S in the vessel. The same scraper assembly can be used on condensers in both processes involving zirconium tetrachloride and hafnium tetrachloride.

Preferably, the scraper assembly 150 is formed of stainless steel elements, but other materials can be used as will occur to those skilled in the art. It is noted that the scraper unit scrapes only the area in and adjacent entrance area 86 and does not disturb the surface area of the vessel at other locations remote from the entrance area 86.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A fluidized bed condenser for condensing zirconium tetrachloride or hafnium tetrachloride to a free flowing solid comprising:

a vertically oriented water cooled vessel;

inlet means defined in a wall of said water cooled vessel for conducting fluid zirconium tetrachloride or hafnium tetrachloride into said water cooled vessel;

a fluidized bed in said water cooled vessel for condensing zirconium tetrachloride or hafnium tetrachloride vapor to a free flowing solid;

a heater surrounding said inlet means for maintaining zirconium tetrachloride or hafnium tetrachloride in a vapor state as those products enter said water cooled vessel, said heater producing enough heat to maintain said zirconium tetrachloride or hafnium tetrachloride in a vapor state until such vapor enters said fluidized bed;

an unheated scraper means mounted on said vessel and located within said vessel only immediately adjacent said wall located inlet means, said scraper means being cooled by particles in said fluidized bed and including at least one arm and means connected to said arm for moving that arm, said arm dislodging solid zirconium tetrachloride or hafnium tetrachloride from adjacent and within said inlet to prevent solid build up in said inlet means; and outlet means for conducting solids out of said vertical vessel, said solids being removed by gravity flow.

2. The condenser defined in claim 1 wherein said scraper means further includes cleanout means affixed thereto which extends into said outlet means for preventing build up of solid material in said outlet means.

3. The condenser defined in claim 2 further including a cleanout rod mounted on said vessel for extension into said outlet means.

4. The condenser defined in claim 3 wherein said scraper further includes a plurality of arms.

5. The condenser defined in claim 4 wherein said scraper further includes a motor mounted on said vessel for moving said scraper.

6. The condenser defined in claim 5 wherein said motor moves said scraper rotationally in the area of chloride buildup.

7. The condenser defined in claim 5 wherein said motor moves said scraper linearly in the area of chloride buildup.

8. The condenser defined in claim 5 wherein said motor moves said scraper vertically in the area of chloride buildup.

9. The condenser defined in claim 5 wherein said motor moves said scraper horizontally in the area of chloride buildup.

10. The condenser defined in claim 1 further including a cleanout assembly which includes a port defined in a wall of said vessel in alignment with said inlet means and a cleanout rod which is forced into said inlet means to clean said inlet means.

11. The condenser defined in claim 10 wherein said cleanout assembly includes a sheath surrounding said cleanout rod.

12. The condenser defined in claim 11 wherein said cleanout rod includes a piercing point thereon.

* * * * *